US006508356B2

(12) United States Patent
Martins

(10) Patent No.: US 6,508,356 B2
(45) Date of Patent: Jan. 21, 2003

(54) DEVICE FOR HOLDING A PLURALITY OF RECEPTACLES

(76) Inventor: Rick Martins, Valley Brook Ave., Lyndhurst, NJ (US) 07071

( * ) Notice: Subject to any disclaimer, the term of this patent is extended or adjusted under 35 U.S.C. 154(b) by 0 days.

(21) Appl. No.: 09/804,533

(22) Filed: Mar. 12, 2001

(65) Prior Publication Data

US 2002/0125149 A1 Sep. 12, 2002

(51) Int. Cl.[7] ..... B65D 71/00; B65B 21/00

(52) U.S. Cl. ..... 206/151; 206/147; 220/23.4; 294/87.2; 53/398

(58) Field of Search ..... 206/139, 147, 206/149, 150, 151, 159, 199, 427, 446; 220/23.4; 294/87.2, 87.22–87.28; 53/398

(56) References Cited

U.S. PATENT DOCUMENTS

| | | | | | |
|---|---|---|---|---|---|
| 2,408,249 | A | * | 9/1946 | Cohn | 294/87.28 |
| 2,426,750 | A | * | 9/1947 | Reutner | 294/87.28 |
| 2,426,756 | A | * | 9/1947 | Ulrich | 294/87.28 |
| 2,454,178 | A | * | 11/1948 | Howell | 294/87.26 |
| 3,285,410 | A | * | 11/1966 | Brunsing | 206/199 |
| 3,572,534 | A | * | 3/1971 | Benoit | 206/427 |
| 4,022,363 | A | * | 5/1977 | Eliassen | 294/87.2 |
| 4,798,286 | A | * | 1/1989 | Muscanelli | 206/150 |
| 5,168,990 | A | * | 12/1992 | Johnson | 206/151 |
| 5,443,298 | A | * | 8/1995 | Finley et al. | 294/87.2 |
| 5,707,096 | A | * | 1/1998 | Gregory | 294/87.2 |

* cited by examiner

*Primary Examiner*—Jim Foster
(74) *Attorney, Agent, or Firm*—Walter J. Tencza, Jr.

(57) ABSTRACT

An apparatus is disclosed for holding and carrying two or more receptacles. The apparatus may be comprised of first and second openings and first and second ridges, wherein a top portion of a first receptacle can be inserted into the first opening, slid along the first and second ridges, and slid into the second opening. In at least one embodiment, third and fourth ridges, and a third opening, may be provided wherein a top portion of a second receptacle can be inserted into the first opening, slid along the third and fourth ridges, and slid into the third opening. The apparatus may further comprise a first central portion and a second central portion, wherein the first and third ridges are connected to the first central portion, and the second and fourth ridges are connected to the second central portion. The first and second central portions may each include curved portions for allowing an individual's fingers to grip the first and second central portions. The apparatus may be further comprised of first, second, third, and fourth substantially straight portions. The first and third substantially straight portions may be connected to a first end and a second end of the first central portion, respectively. The second and fourth substantially straight portions may be connected to a first end and a second end of the second central portion, respectively. The first and third ridges may be connected to the first and third substantially straight portions at an angle with respect to the first and third substantially straight portions. The second and fourth ridges may be connected to the second and fourth substantially straight portions at an angle with respect to the second and fourth substantially straight portions.

19 Claims, 6 Drawing Sheets

DEVICE FOR HOLDING A PLURALITY OF RECEPTACLES

FIELD OF THE INVENTION

This invention relates to improved methods and apparatus for holding a plurality of receptacles, such as bottles or cans, together.

BACKGROUND OF THE INVENTION

Ringed plastic devices for holding together a plurality of receptacles, such as soda cans are known. These ringed plastic devices are difficult to place on. In addition, these prior art devices typically do not allow receptacles of different sizes or different weights to be connected together.

SUMMARY OF THE INVENTION

An apparatus is disclosed for holding two or more receptacles. The receptacles may be, for example, bottles or cans. The apparatus may be comprised of first and second openings and first and second ridges, wherein a top portion of a first receptacle can be inserted into the first opening, slid along the first and second ridges, and slid into the second opening. The first and second ridges may lie opposite from one another. The first and second ridges may span a length from the first opening to the second opening. The first ridge and the second ridge may be closer together at the second opening than at the first opening.

In at least one embodiment, third and fourth ridges, and a third opening, may be provided wherein a top portion of a second receptacle can be inserted into the first opening, slid along the third and fourth ridges, and slid into the third opening. The first, second, third, and fourth ridges may lie opposite from one another. The third and fourth ridges span a length from the first opening to the third opening. The third and fourth ridges may be closer together at the third opening than at the first opening.

An apparatus in accordance with the present invention may further comprise a first central portion and a second central portion, wherein the first and third ridges are connected to the first central portion, and the second and fourth ridges are connected to the second central portion. The first and second central portions may be connected together. The first and second central portions may each include curved portions for allowing an individual's fingers to grip the first and second central portions.

The apparatus may be further comprised of first, second, third, and fourth substantially straight portions. The first central portion may include a first end and a second end and the first and third substantially straight portions may be connected to the first end and the second end of the first central portion, respectively. The second central portion may include a first end and a second end and the second and fourth substantially straight portions may be connected to the first end and the second end of the second central portion, respectively. The first and third ridges may be connected to the first and third substantially straight portions and may be at an angle with respect to the first and third substantially straight portions. The second and fourth ridges may be connected to the second and fourth substantially straight portions and may be at an angle with respect to the second and fourth substantially straight portions. The angle may be ten degrees.

The apparatus may be further comprised of first and second curved end portions which connects the first substantially straight portion to the second substantially straight portion and the third substantially straight portion to the fourth substantially straight portion, respectively. The first and second curved end portions may each be partially circular in shape.

The present invention also includes a method comprising inserting a top portion of a first receptacle into a first opening, sliding the top portion of the first receptacle along first and second ridges, and locking the top portion of the first receptacle into a second opening. The first receptacle may have a lip which is slid along the first and second ridges. The first and second ridges may be separated by a distance which narrows from the first opening towards the second opening. The method may further include inserting a top portion of a second receptacle into the first opening, sliding the top portion of the second receptacle along third and fourth ridges, and locking the top portion of the second receptacle into a third opening. The second receptacle may also have a lip which is slid along the third and fourth ridges. The third and fourth ridges may be separated by a distance which narrows from the first opening towards the third opening.

DETAILED DESCRIPTION OF THE DRAWINGS

Figure 1:
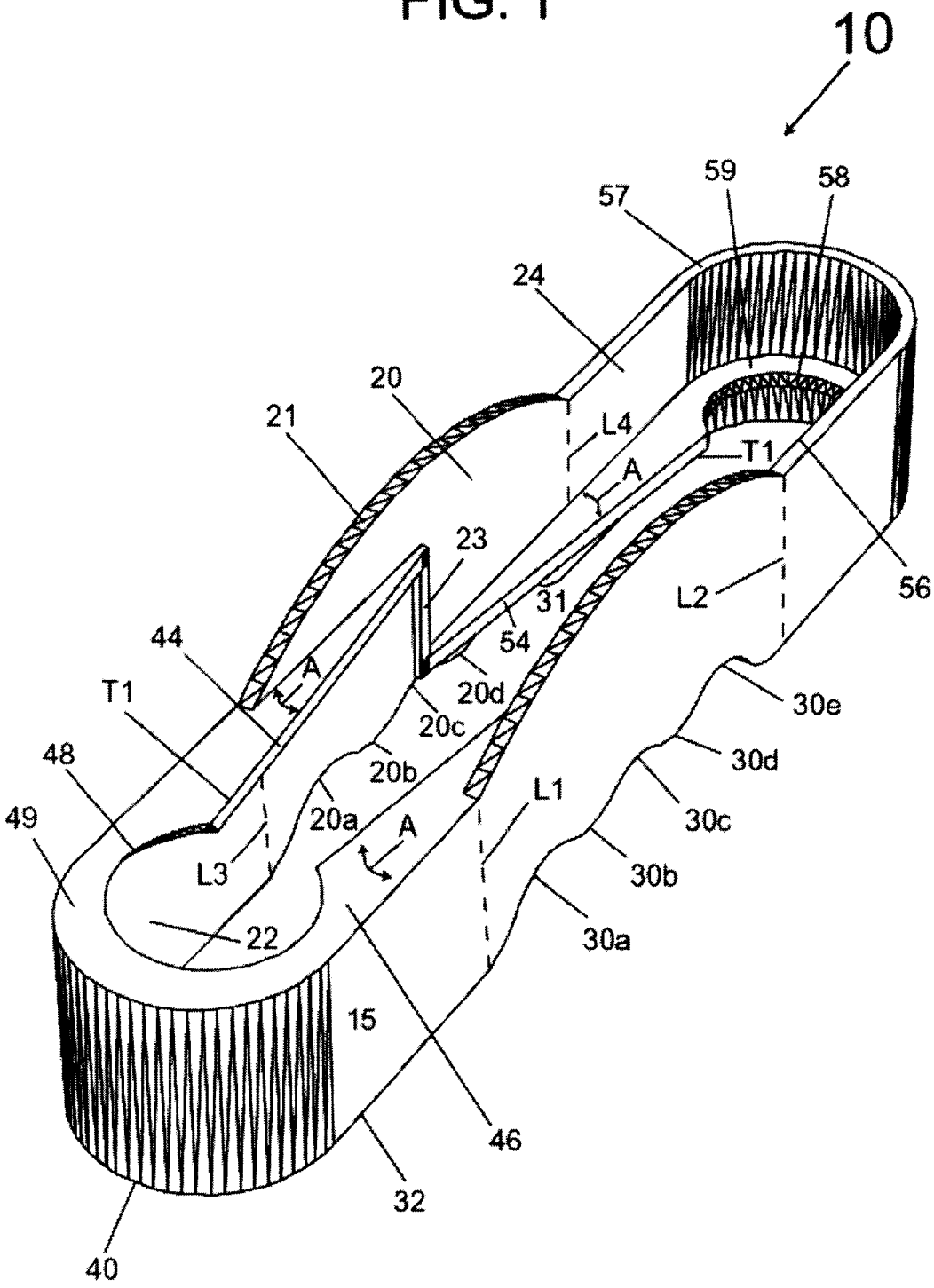
FIG. 1 shows a perspective view of an apparatus for holding together two receptacles in accordance with a first embodiment of the present invention.
Figure 2:
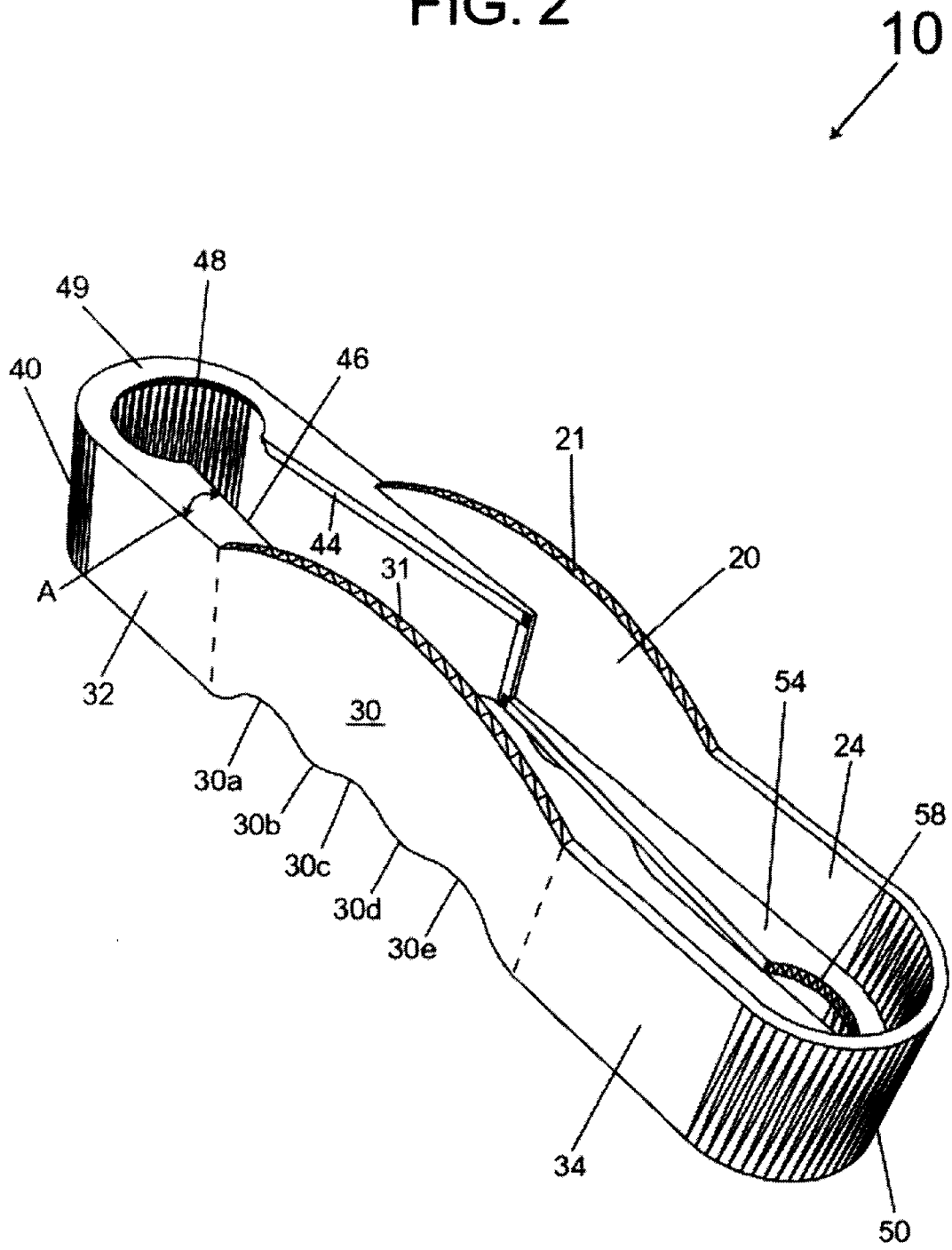
FIG. 2 shows another perspective view of the apparatus of FIG. 1.

FIG. 1 shows a perspective view of an apparatus or holder 10 for holding together two receptacles in accordance with a first embodiment of the present invention. FIG. 2 shows another perspective view of the apparatus 10 of FIG. 1. The apparatus 10 includes central portions 20 and 30, portions 22 and 32, portions 24 and 34, and semi-circular end portions 40 and 50. The central portion 30 may be described as having first and second ends at dashed lines L1 and L2, respectively, shown in FIG. 1, which are connected to substantially straight portions 32 and 34, respectively. The central portion 20 may similarly be described as having first and second ends at dashed lines L3 and L4, respectively, shown in FIG. 1, which are connected to substantially straight portions 22 and 24, respectively.

Central portions 20 and 30 each have a top curved edge 21 and 31, respectively. Central portions 20 and 30 also include curved portions 20*a*, 20*b*, 20*c*20*d*, and 20*e* and 30*a*, 30*b*, 30*c*, 30*d*, and 30*e* respectively. Curved portions 20*a*–20*e* and 30*a*–30*e* allow an individual the ability to comfortably grab central portions 20 and 30 with one hand, in order to pick up apparatus 10 and the receptacles which are held by apparatus 10.

Figure 3:
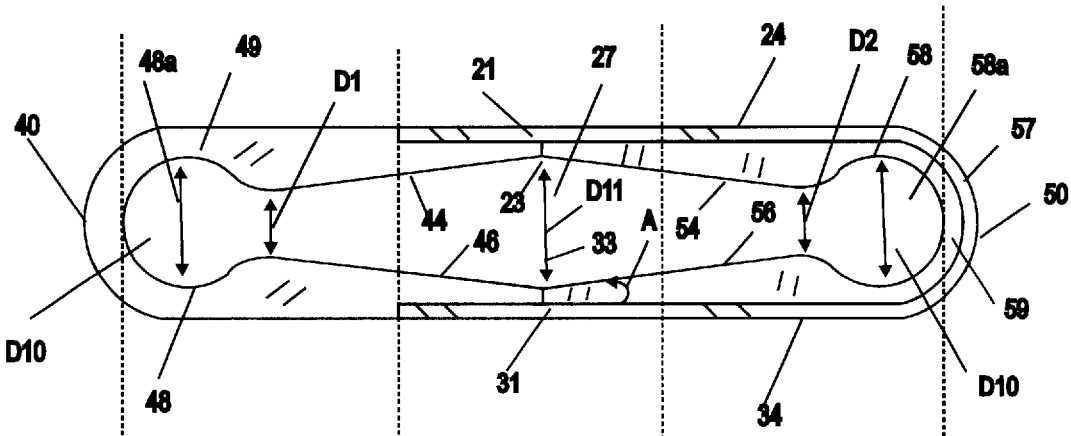
FIG. 3 shows a top view of the apparatus of FIG. 1.

The apparatus 10 also includes straight ridges 44 and 46, partial circular ridge 48, straight ridges 54 and 56, and partial circular ridge 58. The straight ridge 44 is connected to the straight ridge 54 by vertical ridge 23 and the straight ridge 46 is connected to the straight ridge 56 by vertical ridge 33 the location of which is shown in FIG. 3. The ridge 44 may have a thickness of T1 shown in FIG. 1, which may be 0.050 to 0.150 inches or can be determined. The ridges 46, 54, and 56 may have a similar thickness. The apparatus 10 also includes surface or lip 49 and surface or lip 59. The ridges 44 and 46 are farther apart from each other near central opening 27 and nearer each other near opening 48*a*. The ridges 54 and 56 are farther apart from each other near central opening 27 and nearer each other near opening 58*a*.

The ridge 44 is at an angle A with respect to the portion 22. The angle A may be determined by the overall bottle diameters such as the diameters D20 and D21 of bottle 100 and bottle 120, respectively, as well as the lip 102 and lip 122 diameters, and the narrowest diameters of the neck of the bottles 100 and 120, i.e. D3 and D4 The angle A may be for example 10 degrees. Similarly the ridge 46 is at an angle A with respect to portion 32, the ridge 54 is at an angle A with respect to portion 24 and the ridge 56 (shown in FIG. 3) is at an angle A with respect to portion 34.

Figure 4:
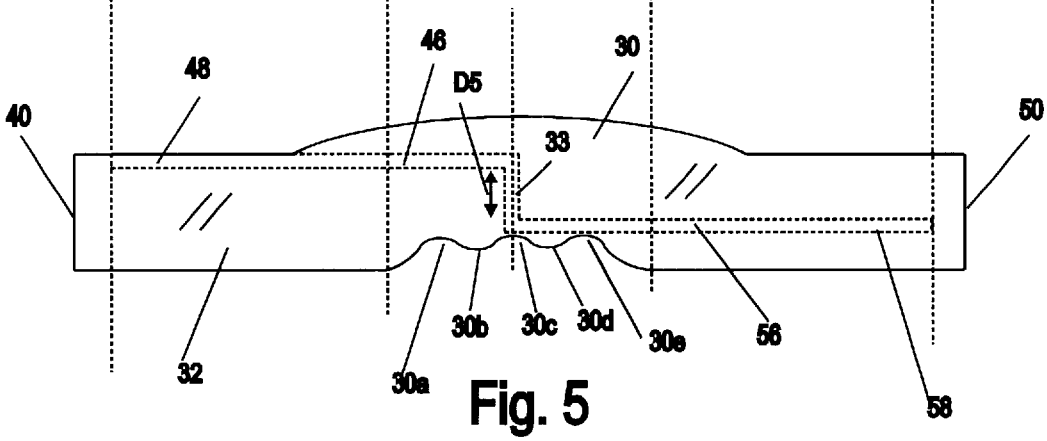
FIG. 4 shows a front view of the apparatus of FIG. 1.
Figure 5:
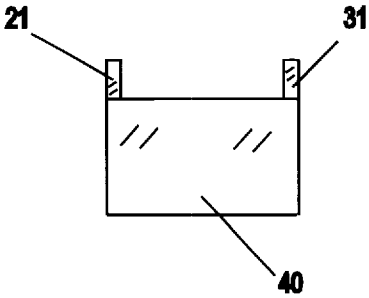
FIG. 5 shows a left side view of the apparatus of FIG. 1.

FIGS. 3–5 show top, front, and left side views of the apparatus of FIG. 1.

Figure 6:
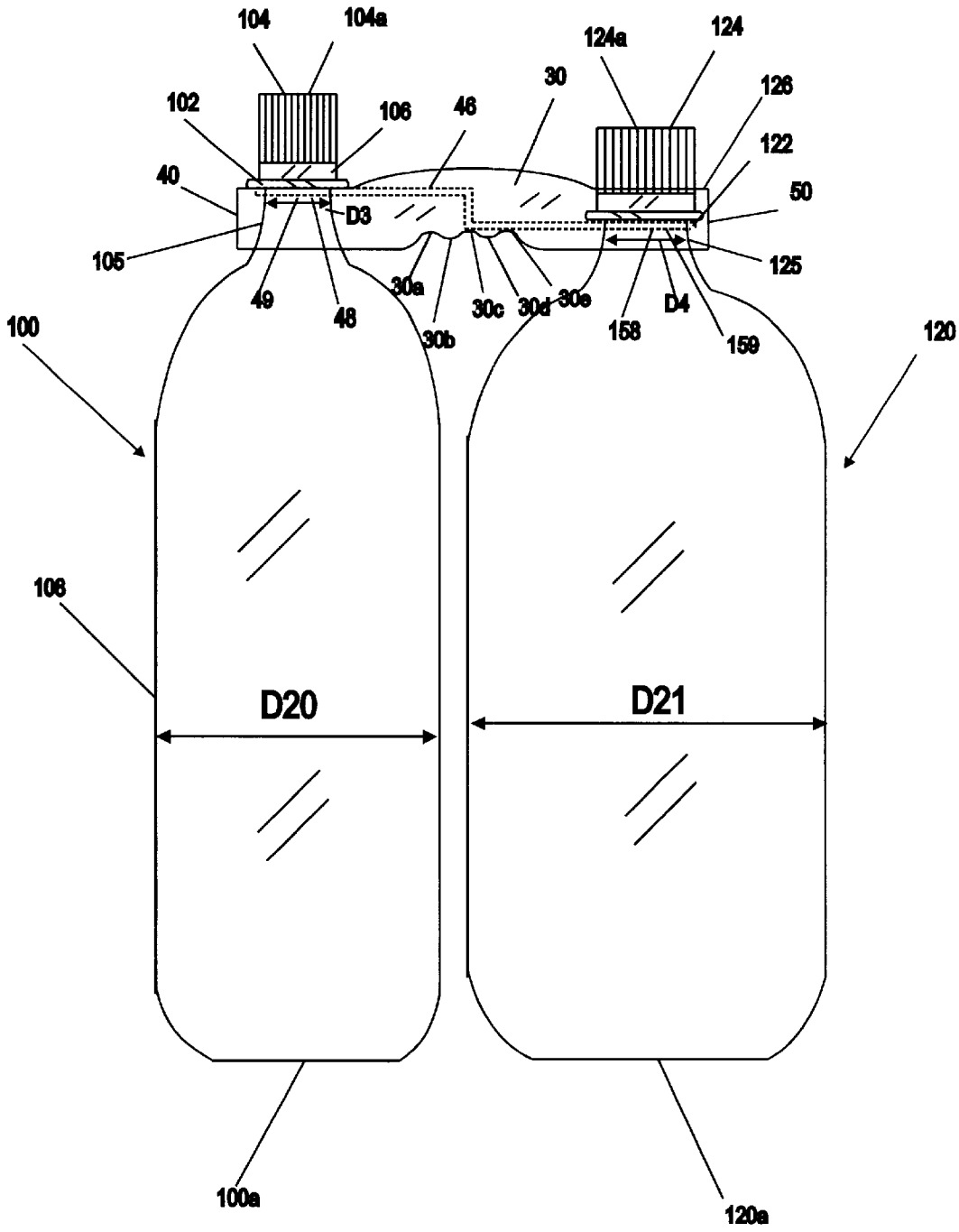
FIG. 6 shows the apparatus of FIG. 1 holding two bottles together.

FIG. 6 shows the apparatus 10 of FIG. 1 holding a bottle 100 and a bottle 120 together. The bottle 100 has a lip 102, a first cap portion 104, a second cap portion 106, and a body 108. The lip 102 of the bottle 100 rests on the surface or lip 49 of the apparatus 10. The ridge 48, ridge 46, ridge 56 and ridge 58 are shown by dashed lines in FIG. 6.

Similarly the bottle 120 has a lip 122, a first cap portion 124, a second cap portion 126, and a body 128. The lip 122 of the bottle 120 rests on the surface or lip 59 of the apparatus 10. An individual can grab the central portion 30 (and central portion 20) by putting his or her fingers under the curved portions 30*a*–30*e* (and portions 20*a*–20*e*) and thereby lift up both bottles or receptacles 100 and 120.

In operation, a user can connect the bottles 100 and 120 to the apparatus 10 as follows. The user may first insert end 104*a* of the bottle 100 through approximately the center 27 (shown in FIG. 3) of the apparatus 10, with the bottle 100 substantially perpendicular to the apparatus 10 and the user inserting the bottle 100 from the side of central portions 20 and 30 with the curved portions 20*a*–*e* and 30*a*–*e*. The end 104*a* of the bottle 100 may be considered a top portion of the bottle 100. The bottle 100 is pushed through the opening 27 in apparatus 10 so that the lip 102 of the bottle 100 is over the ridge 46 shown. in dashed line form in. FIG. 6. The user then slides the bottle 100 over the ridge 46 until the lip 102 is over the partially circular ridge 48. During this sliding process the ridges 44 and 46 will be pushed apart from one another by the neck 105 of the bottle 100, so that the distance D1 is increased from that shown in FIG. 3. The bottle 100 then is locked in the location shown in FIG. 6 in the partially circular opening 48*a* shown in FIG. 3. When the bottle 100 reaches the opening 48*a* shown in FIG. 3, the ridges 44 and 46 contract back to the rest position shown in FIG. 3. The rest distance of D1 should be less than the narrowest diameter, D3, of the neck 105 of the bottle 100.

Similarly, after the user has locked in bottle 100 the user may insert end 124*a* of the bottle 120 through approximately the center 27 (shown in FIG. 3) of the apparatus 10, with the bottle 120 substantially perpendicular to the apparatus 10 and the user inserting the bottle 120 from the side of central portions 20 and 30 with the curved portions 20*a*–*e* and 30*a*–*e*. The end 124*a* may be considered a top portion of the bottle 120. The bottle 120 is pushed through the opening 27 in apparatus 10 so that the lip 122 of the bottle 120 is over the ridge 56 shown in dashed line form in FIG. 6. The user then slides the bottle 120 over the ridge [46] 56 until the lip 122 is over the partially circular ridge 58. During this sliding process the ridges 54 and 56 will be pushed apart from one another by the neck 125 of the bottle 120, so that the distance D2 is increased from that shown in FIG. 3. The bottle 120 then is locked in the location shown in FIG. 6 in the circular opening 58*a* shown in FIG. 3. When the bottle 120 reaches the opening 58*a* shown in FIG. 3, the ridges 54 and 56 contract back to the rest position shown in FIG. 3. The rest distance of D1 distance of D1 should be less than the narrowest diameter, D4, of the neck 125 of the bottle 120.

In accordance with the present invention, the different levels for the left side ridges, i.e. 44, 46, and 48, versus the right side ridges, i.e. 54, 56, and 58, as shown by FIGS. 3 and 4 allow bottles of different sizes or having different lips at different locations to be matched. For example, as shown in FIG. 6, the bottle 100 and the bottle 120 have been connected together so that the their bottom ends 100*a* and 120*a* are even with one another or at the same vertical location, even through their lips 102 and 122 are at different vertical locations. This arrangement may allow the weight of the combination of apparatus 10 and bottles 100 and 120 to be fairly evenly distributed, which may make it easier to carry.

The openings 48*a* and 58*a* may have a largest dimension of D10, shown in FIG. 3, which would be the diameter of the openings 48*a* and 58*a* if they were completed circles. The dimension of D10 may be determined by product package requirements and should be smaller than the diameter of the lips 102 and 122. The central opening 27 may have a largest dimension D11, which may be determined by product package requirements. D11 could be larger or slightly smaller than the diameter of the lips 102 or 122 Inserting either bottle 100 or 120 may require the central opening 27 to enlarge. The apparatus 10 may be made of a flexible plastic material which may enlarge when the bottles are forced into the opening 27.

Figure 7:
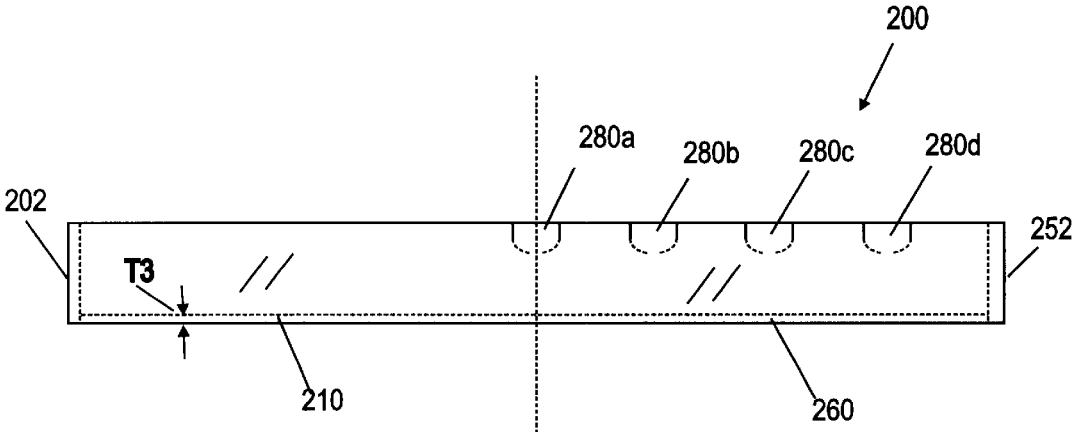
FIG. 7 shows a front view of an apparatus for holding a plurality of receptacles together in accordance with a second embodiment of the present invention.
Figure 8:
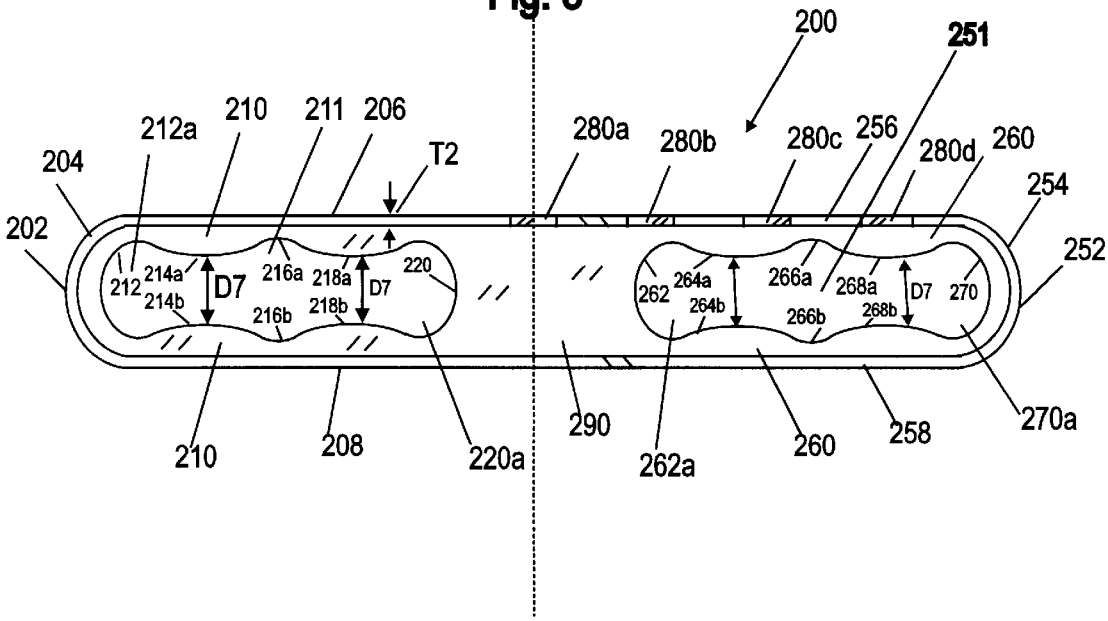
FIG. 8 shows a top view of the apparatus of FIG. 7.

FIG. 7 shows a front view of an apparatus 200 for holding a plurality of receptacles together in accordance with a second embodiment of the present invention. FIG. 8 shows a top view of the apparatus 200 of FIG. 7. The apparatus 200 includes portions 202, 206, 208, 252, 256, and 258, which are integrated together in a loop in the form of a thin wall having a thickness T2, which may be similar to T1. The apparatus 200 also includes flat surfaces 210, 290, and 260 which are integrated together.

Openings 211 and 251 are also shown. Opening 211 is bound by semicircular ridge 212, curved ridges 214*a*, 214*b*, 216*a*, 216*b*, 218*a*, 218*b*, and semicircular ridge 220. The ridges 212, 214*a*–*b*, 216*a*–*b*, 218*a*–*b*, and 220 may have a thickness of T3 shown in FIG. 7, which may be similar to T1. Similarly, opening 251 is bound by semicircular ridge 262, curved ridges 264*a*, 264*b*, 266*a*, 266*b*, 268*a*, 268*b*, and semicircular ridge 270. The ridges 262, 264*a*–*b*, 266*a*–*b*, 268*a*–*b*, and 270 may have a thickness of T3. U-shaped recesses 280*a*–*d* may allow an individual to easily grip the apparatus 200.

Figure 9:
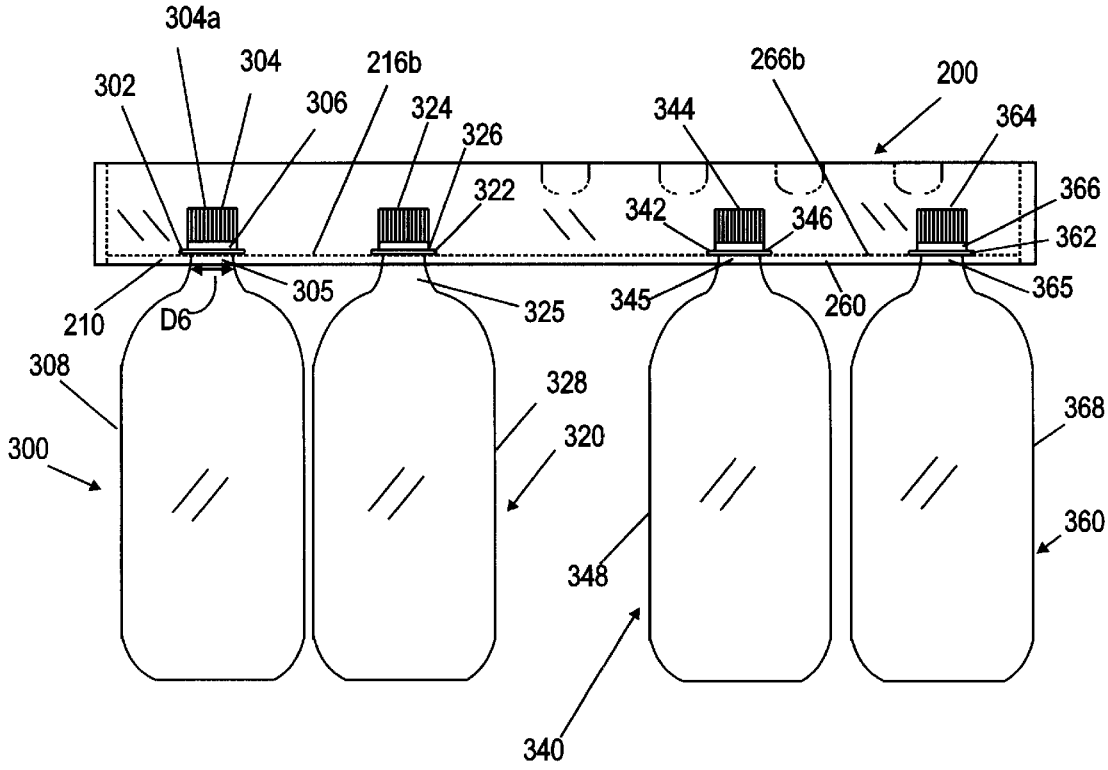
FIG. 9 shows the apparatus of FIG. 7 holding receptacles together.

FIG. 9 shows the apparatus 200 of FIG. 7 holding receptacles, in this case, bottles 300, 320, 340, and 360. Bottle 300 includes lip 302, cap portion 304, neck 305, cap portion 306, and body 308. Similarly bottles 320, 340, and

360 includes lips 322, 342, and 362, respectively, cap portions 324, 344, and 364, respectively, necks 325, 345, and 365, respectively, cap portions 326, 346, and 366, respectively, and bodies 328, 348, and 368, respectively.

In operation, a user can connect the bottles 300, 320, 340, and 360 to the apparatus 200 as follows. The user may first insert end 304*a* of the bottle 300 through approximately the center of opening 211 (shown in FIG. 8) of the apparatus 200, with the bottle 300 substantially perpendicular to the apparatus 200 and the user inserting the bottle 300 from underneath the apparatus 200. The bottle 300 is pushed through the opening 211 in apparatus 200 so that the lip 302 of the bottle 300 is over the ridges 216*a* and 216*b* shown in FIG. 8. The user then slides the bottle 300 over the ridge 214*a* and 214*b* until the lip 302 is over the semi-circular ridge 212. During this sliding process the ridges 214*a* and 214*b* will be pushed apart from one another by the neck 305 of the bottle 300, so that the distance D7 in FIG. 8 is increased from that shown in FIG. 8. The bottle 300 then is locked in the location shown in FIG. 9 in the circular opening 212a shown in FIG. 8. When the bottle 300 reaches the opening 212*a* shown in FIG. 8, the ridges 214*a* and 214*b* contract back to the rest position shown in FIG. 8. The rest distance of D7 should be less than the narrowest diameter, D6, of the neck 305 of the bottle 300 shown in FIG. 9.

The bottles 320, 340, and 360 are connected to the apparatus 200 in a similar manner to the bottle 300. Bottle 320 is inserted into opening 211 and slid over ridges 218a and 218b, causing the distance D7 between ridges 218*a* and 218*b* to increase, and then into lock position in the semi-circular opening 220*a* which causes the ridges 218*a* and 218*b* to go back to the rest position shown in FIG. 8. Bottle 340 is inserted into opening 251 and slid over ridges 264*a* and 264*b,* causing the distance D7 between ridges 264*a* and 264*b* to increase, and then the bottle 340 is slid into lock position in the semi-circular opening 262*a* which causes the ridges 264*a* and 264*b* to go back to the rest position shown in FIG. 8. Bottle 360 is inserted into opening 251 and slid over ridges 268*a* and 268*b,* causing the distance D7 between ridges 268*a* and 268*b* to increase, and then the bottle 360 is slid into lock position in the semi-circular opening 270*a* which causes the ridges 268*a* and 268*b* to go back to the rest position shown in FIG. 8.

The apparatus 10 and apparatus 200 each can be made as integrated pieces. Each of apparatus 10 and apparatus 200 can have a specified snap lock friction fit area for each different type of product. For example, for apparatus 10, ridges 44, 46, 48, surface 49 and opening 48*a* can be designed for a specific product with a specific size neck and lip (such as neck 105 and lip 102 of bottle 100 in FIG. 6) while ridges 54, 56, 58, surface 59 and opening 58*a* can be designed for a different product with a different size (such as neck 125 and lip 122 of bottle 120 in FIG. 6). The apparatus 10 can be manufactured with an appropriate vertical allowance, i.e. the distance D5 shown in FIG. 4 between ridge 56 and ridge 46, to take into account the difference between receptacle types, if any, such as the difference between bottle 100 and bottle 120.

The hand grip area portions 20 and 30 (including curved portions 20*a–e* and 30*a–e*) are ergonomically designed. The ridges 44, 46, 48, 54, 56, and 58 can be used to grip minute areas of a bottle's neck and cap. The large flat area on central portions 20 and 30 allows for promotional decorations.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. An apparatus for holding two or more receptacles comprised of:

a first opening;

a first ridge;

a second ridge;

a second opening;

a third opening;

a third ridge; and a fourth ridge;

wherein a top portion of a first receptacle can be inserted into the first opening, slid along the first and second ridges, and slid into the second opening;

wherein a top portion of a second receptacle can be inserted into the first opening, slid along the third and fourth ridges, and slid into the third opening;

and wherein when the apparatus is in an upright position the first and second ridges are at a first vertical level and the third and fourth ridges are at a second vertical level, wherein the first and second vertical levels are substantially different.

2. The apparatus of claim 1 wherein the first ridge and the second ridge lie opposite from one another; and wherein the third and fourth ridge lie opposite from one another.

3. The apparatus of claim 1 wherein the first ridge and the second ridge span a length from the first opening to the second opening;

and the first ridge and the second ridge are closer together at the second opening than at the first opening.

4. The apparatus of claim 1 further wherein the first ridge, the second ridge, the third ridge and the fourth ridge are parallel to each other.

5. The apparatus of claim 2 wherein the first ridge, the second ridge, the third ridge and the fourth ridge are parallel to each other.

6. The apparatus of claim 1 wherein the first and second ridges span a length from the first opening to the second opening;

the third and fourth ridges span a length from the first opening to the third opening;

the first ridge and the second ridge are closer together at the second opening than at the first opening; and the third and fourth ridges are closer together at the third opening than at the first opening.

7. The apparatus of claim 1 further comprising a first central portion and a second central portion;

wherein the first and third ridges are connected to the first central portion, and the second and fourth ridges are connected to the second central portion;

wherein the first and second central portions are connected together.

8. The apparatus of claim 7 wherein the first and second central portions each include curved portions for allowing an individual's fingers to grip the first and second central portions.

9. The apparatus of claim 7 further comprised of first, second, third, and fourth substantially straight portions;

wherein the first central portion includes a first end and a second end and the the first and third substantially straight portions are connected to the first end and the second end of the first central portion, respectively;

wherein the second central portion includes a first end and a second end and the second and fourth substantially straight portions are connected to the first end and the second end of the second central portion, respectively;

wherein the first and third ridges are connected to the first and third substantially straight portions and are at an angle with respect to the first and third substantially straight portions; and wherein the second and fourth ridges are connected to the second and fourth substantially straight portions and are at an angle with respect to the second and fourth substantially straight portions.

10. The apparatus of claim 9 wherein the angle is about ten degrees.

11. The apparatus of claim 9 further comprised of first and second curved end portions;

wherein the first curved end portion connects the first substantially straight portion to the second substantially straight portion;

and the second curved end portion connects the third substantially straight portion to the fourth substantially straight portion.

12. The apparatus of claim 11 further wherein the first and second curved end portions are each partially circular in shape.

13. A method comprising the steps of:

inserting a top portion of a first receptacle into a first opening;

sliding the top portion of the first receptacle along first and second ridges;

locking the top portion of the first receptacle into a second opening;

inserting a top portion of a second receptacle into the first opening;

sliding the top portion of the second receptacle along third and fourth ridges;

and locking the top portion of the second receptacle into a third opening;

and wherein the first and second ridges are at a first vertical level and the third and fourth ridges are at a second vertical level, wherein the first and second vertical levels are substantially different.

14. The method of claim 13 wherein the first receptacle has a lip and the lip is slid along the first and second ridges.

15. The method of claim 13 wherein the first and second ridges are separated by a distance, which narrows from the first opening towards the second opening.

16. The method of claim 13 wherein the first, second, third, and fourth ridges are parallel to each other.

17. The method of claim 13 wherein the second receptacle has a lip and the lip is slid. along the third and fourth ridges.

18. The method of claim 17 wherein the third and fourth ridges are separated by a distance, which narrows from the first opening towards the third opening.

19. An apparatus comprised of:

a first receptacle;

a second receptacle;

a holder for holding two or more receptacles comprised of:

a first opening;
a first ridge;
a second ridge;
a second opening;
a third opening;
a third ridge; and
a fourth ridge;

wherein a top portion of the first receptacle can be inserted into the first opening, slid along the first and second ridges, and slid into the second opening;

wherein a top portion of a second receptacle can be inserted into the first opening, slid along the third and fourth ridges, and slid into the third opening; and and wherein when the apparatus is in an upright position, the first and second ridges are at a first vertical level and the third and fourth ridges are at a second vertical level, wherein the first and second vertical levels are substantially different.

* * * * *